United States Patent [19]

Vicai

[11] 4,039,889

[45] Aug. 2, 1977

[54] BLUE-WHITE GLOW LAMP

[75] Inventor: Egon Vicai, Gates Mills, Ohio

[73] Assignee: General Electric Company, Schenectady, N.Y.

[21] Appl. No.: 661,302

[22] Filed: Feb. 25, 1976

[51] Int. Cl.[2] ..... H01J 61/16; H01J 61/44

[52] U.S. Cl. ..... 313/487; 313/185; 313/226

[58] Field of Search ..... 313/226, 487, 185

[56] References Cited

U.S. PATENT DOCUMENTS

| | | | |
|---|---|---|---|
| 2,207,174 | 7/1940 | Jenkins | 313/487 |
| 2,622,221 | 12/1952 | Beese | 313/185 X |
| 3,287,586 | 11/1966 | Bickford | 313/487 |
| 3,602,758 | 8/1971 | Thornton et al. | 313/487 |
| 3,686,686 | 8/1972 | Hall | 315/169 R |
| 3,704,386 | 11/1972 | Cola et al. | 313/484 |
| 3,743,879 | 7/1973 | Kupsky | 313/484 |
| 3,814,969 | 6/1974 | Kamiya et al. | 313/486 |
| 3,878,422 | 4/1975 | Brown et al. | 313/486 |
| 3,916,245 | 10/1975 | Dorf et al. | 313/226 X |

OTHER PUBLICATIONS

"Fluorescent Lamps and Lighting," by W. Elenbaas, 1962, pp.42, 43, 44.

*Primary Examiner*—Palmer C. Demeo
*Attorney, Agent, or Firm*—Paul F. Wille; Lawrence R. Kempton; Frank L. Neuhauser

[57] ABSTRACT

A bluish-white glow lamp is described having a gas mixture comprising neon and xenon and a phosphor coating on the inside of the envelope comprising zinc silicate and calcium tungstate.

6 Claims, 3 Drawing Figures

BLUE-WHITE GLOW LAMP

BACKGROUND OF THE INVENTION

This invention relates to cathode or negative discharge glow lamps and, in particular, to glow lamps producing whiter light than has been provided in the prior art.

Glow lamps having a fluorescent coating are known in the art. For example, U.S. Pat. No. 2,409,769—Leyshon describes such a glow lamp utilizing a manganese-activated zinc silicate (green) phosphor. The particular lamp described has a pronounced green color and uses less than 1% krypton in the gas at a pressure of $4.7 \times 10^3$ pascals (35 mm Hg). Thus, the lamp does not produce as white a light as desired and tends to have a short life due to sputtering of the electrodes.

Phosphor mixtures are well known in the fluorescent lamp art to achieve the desired color of light from the lamp. However, fluorescent lamps rely on ultraviolet radiation, particularly the strong radiation at 253.7 nm, produced by a mercury arc as the source of energy for the phosphors. As is known, it is much more difficult to use mercury as an unltrviolet radiation source in a negative discharge.

While it is known to use krypton or xenon as the source of ultraviolet radiation in negative discharge devices, it is not known to use multiple phosphors in such devices and, particularly, to use one phosphor to excite another, thereby producing a whiter light.

In general, it is desirable to have a glow lamp producing white light since any narrower spectrum color is easily obtained by filtering. For example, glow lamps are predominantly used as indicators. By providing a whiter light glow lamp, one can use a single lamp type and obtain different colors simply by filtering, thereby reducing parts inventories and costs.

SUMMARY OF THE INVENTION

In view of the foregoing, it is therefore an object of the present invention to provide a fluorescent glow lamp producing whiter light.

Another object of the present invention is to provide a multiple phosphor glow lamp wherein one phosphor is excited at least partially by another.

A further object of the present invention is to provide an improved fluorescent glow lamp wherein one phosphor may be used with or without an activating material.

The foregoing objects are achieved in the present invention wherein it has been discovered that combining manganese-activated zinc silicate with calcium tungstate produces a bluish-white appearing glow lamp whose color is whiter than those of the prior art. The color is obtained from the neon and xenon gases and the phosphor mixture. A portion of the xenon spectrum excites the manganese-activated zinc silicate (green) phosphor which excites the calcium tungstate (blue) phosphor. The calcium tungstate may be lead activated, if desired, which produces a more intense blue component.

BRIEF DESCRIPTION OF THE DRAWINGS

A more complete understanding of the present invention can be obtained by considering the following detailed description in conjunction with the accompanying drawings, in which.

DESCRIPTION OF THE PREFERRED EMBODIMENT

Figure 1:
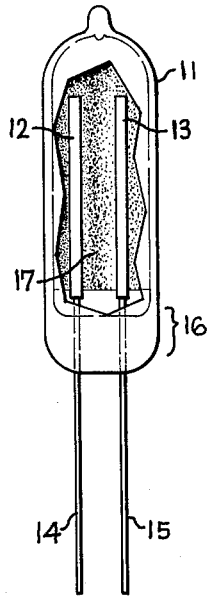
FIG. 1 illustrates a glow lamp coated in accordance with the present invention.

FIG. 1 illustrates a glow lamp having a coating on the interior of the bulb comprising a fluorescent phosphor mixture. Specifically, the glow lamp comprises a glass envelope 11 with electrodes 12 and 13 positioned therein. Electrodes 12 and 13 are approximately parallel and spaced 0.7 mm apart. Electrodes 12 and 13 preferably comprise nickel-plated iron wire in which the nickel coating substantially eliminates sputtering of the electrodes during the operation of the lamp. Electrodes 12 and 13 are connected to leads 14 and 15, respectively, by any suitable means, for example, by welding. Leads 14 and 15 extend through seal area 16 of envelope 11 to join electrodes 12 and 13.

The interior of envelope 11 is coated with a phosphor mixture 17 which preferably comprises a mixture of manganese-activated zinc silicate and calcium tungstate in a ratio of 2:3 parts by weight, respectively.

A suitable phosphor has been made by ball-milling 80 grams of manganese-activated zinc silicate and 120 grams calcium tungstate to an average particle size of 3.5 microns. 200 ml of nitrocellulose binder and 30 ml butyl acetate thinner plus 20 ml diabutyl phalatate are then added to provide a suspension of the phosphor particles in the liquid vehicle. The lamps were then coated and dried and approximately 6 mm (¼inch) was cleaned back from the phosphor-coated end to provide clear glass for the sealing operation. After the end cleaning, the envelopes were then lehred at 550°C for 1.5 minutes.

The composition of the gas utilized in lamps according to the present invention may comprise from 1–15% xenon, balance neon. A preferred value is 5% xenon and 95% neon. Varying the percentage of xenon changes the hue and varies the firing voltage. Greater than 15% xenon results in too high a firing voltage with an electrode spacing of 0.7 mm. Within the ranges specified, lamps made in accordance with the present invention have a firing voltage of from 85–125 volts d.c., and a maintaining voltage of 45–70 volts d.c.

Figure 2:
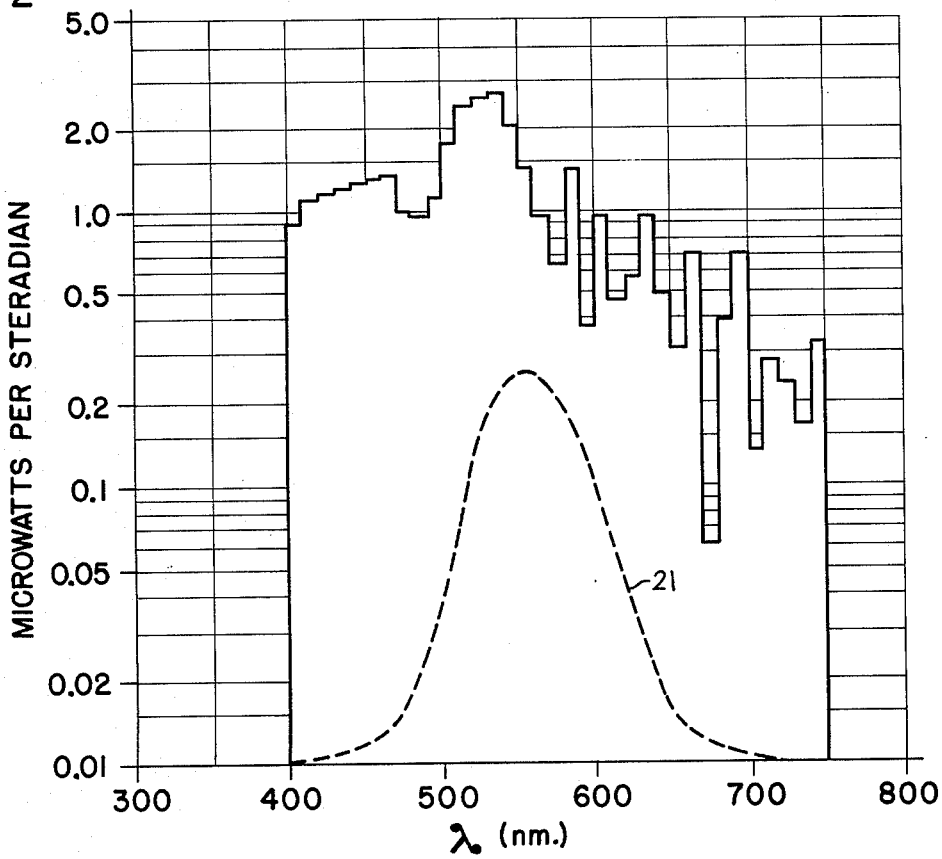
FIG. 2 illustrates the radiant intensity distribution for a glow lamp in accordance with the present invention.

The radiant intensity distribution for glow lamps made in accordance with the present invention is illustrated in FIG. 2. The distribution illustrated in FIG. 2 has not been corrected for luminous efficiency, i.e., FIG. 2 illustrates the output of the lamp in microwatts per steradian without regard to the relative response of the human eye, illustrated by dotted curve 21. As can be seen by inspection of FIG. 2, the output of lamps in accordance with the present invention covers the entire visible spectrum and provides substantial output at shorter wavelengths, e.g., less than 500 nm. This counterbalances the lower photopic response of the eye to these wavelengths, making the light from the lamp appear whiter and slightly bluish.

Figure 3:
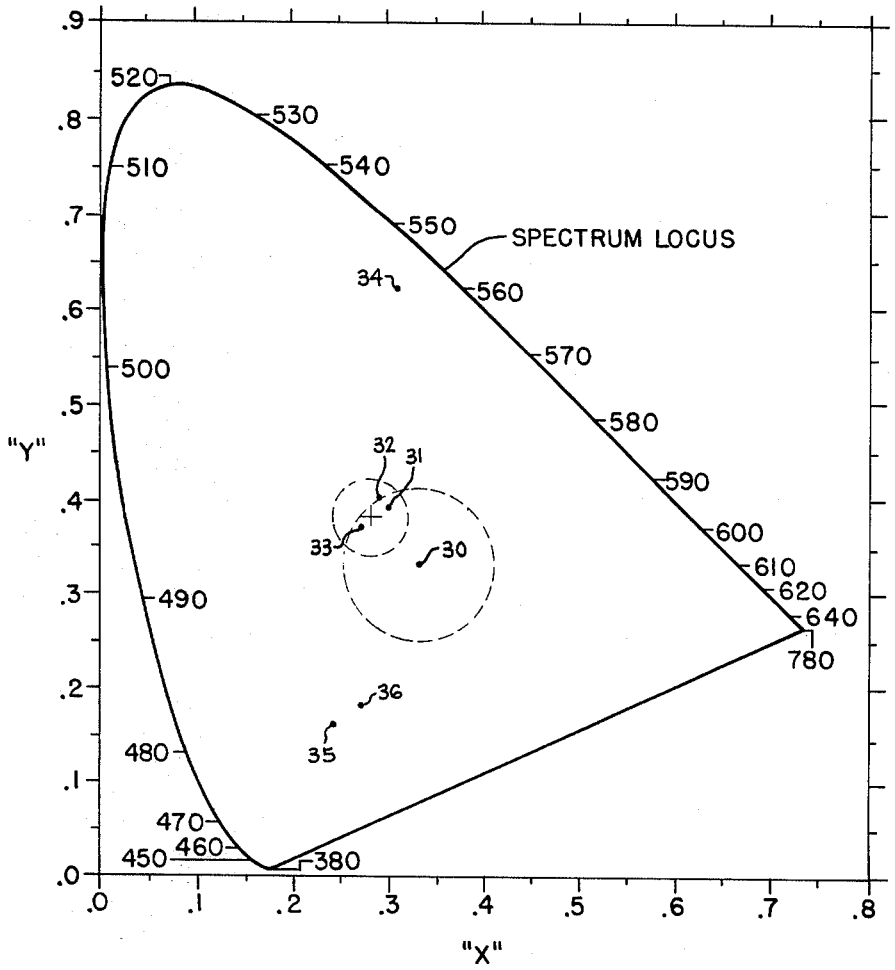
FIG. 3 illustrates the CIE chromaticity diagram.

FIG. 3 illustrates the CIE (Commission Internationale De L'Eclairage) diagram on which the coordinates for various lamps are plotted. Reference numeral 30 indicates the equal energy or achromatic (white light) point ($x = 0.3333$; $y = 0.3333$; $z = 0.3333$). As known by those familiar with this standard diagram, $x+y+z = 1$. Therefore, only $(x, y)$ coordinates are given hereafter.

A lamp made in accordance with the present invention, having a 95% neon, 5% xenon gas mixture, an electrode spacing of 0.7 mm and a manganese-activated zinc silicate-calcium tungstate phosphor, produced 0.09 lumens at 2.5 milliamperes current. The tristimulus values of the lamp are:

$X_B = 0.1292$
$X_R = 0.6481$
$X = 0.7773$
$Y = 1.000$
$Z = 0.7682$ which corresponds to chromaticity coordinates of:

$x = 0.31$
$y = 0.39$ designated in FIG. 3 by reference number 31.

Another lamp, otherwise identical, comprising lead-activated calcium tungstate produced 0.11 lumens and had chromaticity coordinates of:

$x = 0.30$
$y = 0.40$ designated by reference number 32 in FIG. 3.

Another lamp, otherwise identical to the immediately preceding lamp, but made at a different time, had chromaticity coordinates of:

$x = 0.28$
$y = 0.37$ indicated by reference number 33 in FIG. 3.

Of the points described thus far, it can be seen by inspection of FIG. 3 that lamps in accordance with the present invention are within a radius of 0.04 of coordinates (0.29; 0.38 ) and within a radius of 0.08 of the equal energy point. While it is understood that manufacturing variations may cause the chromaticity coordinates to vary somewhat, nevertheless, lamps in accordance with the present invention are whiter than those of the prior art, as shown by their proximity to the equal energy point, permitting a variety of colors by filtering.

By way of contrast, an otherwise identical lamp comprising only manganese-activated zinc silicate produced 0.2 lumens and had chromaticity coordinates of:

$x = 0.32$
$y = 0.62$ indicated by reference numeral 34 in FIG. 3. An otherwise identical lamp comprising only lead-activated calcium tungstate produced 0.0095 lumens and had chromaticity coordinates of:

$x = 0.28$
$y = 0.18$ indicated by reference numeral 35 in FIG. 3.

An otherwise identical lamp comprising only calcium tungstate produced 0.0080 lumens and had chromaticity coordinates of:

$x = 0.25$
$y = 0.16$ indicated by reference numeral 36.

As known by those of skill in the art, the CIE chromaticity diagram enables one to compare the color of different sources of light objectively, i.e., it is not concerned with luminous efficiency, which would tend to push all light sources toward the "green" region of the diagram. Stated another way, the chromaticity diagram enables one to compare light sources photometrically and obtain quantitative data. The appearance of the light source to a human observer is only broadly indicated by the diagram and is subjective. However, as previously noted, lamps in accordance with the present invention appear bluish-white.

The color of the light generated by the glow lamp in accordance with the present invention is a combination of the outputs from the neon and xenon gases and the phosphor mixture. In the phosphor mixture, a portion of the xenon spectrum excites the manganese-activated zinc silicate (green) phosphor. This phosphor, in turn, excites the calcium tungstate (blue) phosphor. While it is not known how much, if any, of the calcium tungstate may be directly activated by the xenon in the discharge, the response of the calcium tungstate to the xenon discharge may be increased by utilizing a lead activator. Lead-activated calcium tungstate produces a more intense blue component, giving the lamp a bluish appearance.

Having thus described the invention, it will be apparent to those of skill in the art that various modifications may be made within the spirit and scope of the present invention.

What I claim as new and desire to secure by Letters Patent of the United States is:

1. A negative discharge glow lamp comprising:
a light translucent envelope;
at least two electrodes positioned approximately parallel to each other inside said envelope;
an atmosphere inside said envelope consisting essentially of 1–15% xenon, balance neon, at a pressure of from $6.6 \times 10^3$ to $1.5 \times 10^4$ pascals absolute; and
a phosphor coating on the interior of said envelope comprising a mixture of manganese-activated zinc silicate and calcium tungstate phosphors;
said lamp characterized by a firing voltage of 80–125 volts d.c., a maintaining voltage of 40–70 volts d.c., and a light output having coordinates within a radius of 0.04 of point (0.29; 0.38) on the CIE chromaticity diagram.

2. The device as set forth in claim 1 wherein said device produces radiant energy having coordinates within a radius of 0.08 of the equal energy point on the CIE chromaticity diagram.

3. The device as set forth in claim 2 wherein said device produces radiant energy having the coordinates (0.31; 0.39) on said diagram.

4. The device as set forth in claim 1 wherein phosphor-activated phosphor further comprises a lead activator.

5. The device as set forth in claim 1 wherein said electrodes are space 0.7 millimeters from each other.

6. The device as set forth in claim 1 wherein said radiant energy is produced at a current of approximately 2.5 milliamperes.

* * * * *